US010104905B2

(12) United States Patent
Bez

(10) Patent No.: US 10,104,905 B2
(45) Date of Patent: Oct. 23, 2018

(54) SUCTION BELT

(71) Applicant: Max Schlatterer GmbH & Co. KG, Herbrechtingen (DE)

(72) Inventor: Frank Bez, Bartholomae (DE)

(73) Assignee: Max Schlatterer GmbH & Co. KG, Herbrechtingen (DE)

( * ) Notice: Subject to any disclaimer, the term of this patent is extended or adjusted under 35 U.S.C. 154(b) by 0 days.

(21) Appl. No.: 15/534,984

(22) PCT Filed: Dec. 10, 2015

(86) PCT No.: PCT/EP2015/079192
§ 371 (c)(1),
(2) Date: Jun. 9, 2017

(87) PCT Pub. No.: WO2016/091989
PCT Pub. Date: Jun. 16, 2016

(65) Prior Publication Data

US 2017/0360080 A1 Dec. 21, 2017

(30) Foreign Application Priority Data

Dec. 11, 2014 (EP) ..... 14197395

(51) Int. Cl.

| | |
|---|---|
| ***B65G 15/52*** | (2006.01) |
| ***A24C 5/39*** | (2006.01) |
| ***A24C 5/18*** | (2006.01) |
| ***D03D 1/02*** | (2006.01) |
| ***D03D 13/00*** | (2006.01) |

(52) U.S. Cl.
CPC ..... *A24C 5/396* (2013.01); *A24C 5/1857* (2013.01); *D03D 1/02* (2013.01); *D03D 13/00* (2013.01)

(58) Field of Classification Search
CPC ..... B65G 15/58; B65G 21/2027; B65G 21/2036; D03D 1/02; D03D 13/00; A24D 3/08; A24D 3/048; A24D 3/10; A24D 3/04; A24C 5/396
USPC ..... 198/689.1; 131/84.1, 84.3, 110; 156/252
See application file for complete search history.

(56) References Cited

U.S. PATENT DOCUMENTS

| | | | | | |
|---|---|---|---|---|---|
| 4,721,119 | A * | 1/1988 | Ludszeweit | A24C 5/24 | 131/67 |
| 5,072,742 | A * | 12/1991 | Heitmann | A24C 5/18 | 131/110 |
| 5,649,551 | A * | 7/1997 | Bottger | A24C 5/18 | 131/84.1 |
| 5,857,561 | A * | 1/1999 | Hardman | A24C 5/1857 | 198/689.1 |

(Continued)

FOREIGN PATENT DOCUMENTS

| | | |
|---|---|---|
| DE | 1932616 | 1/1970 |
| DE | 19909031 | 9/2000 |

(Continued)

*Primary Examiner* — James R Bidwell
(74) *Attorney, Agent, or Firm* — Wells St. John P.S.

(57) ABSTRACT

The invention relates to a suction belt for transporting tobacco and/or filter material in the production of cigarettes. The suction belt has a flat belt material that is formed into a ring and has a plurality of openings that are disposed so as to be distributed across the surface of the belt material. The suction belt is characterized in that at least 75% of all openings have an available extent of 0.3 mm or less.

15 Claims, 2 Drawing Sheets

(56) References Cited

U.S. PATENT DOCUMENTS

| | | | | |
|---|---|---|---|---|
| 6,186,315 | B1 * | 2/2001 | Schmick | A24C 5/1807 131/280 |
| 8,485,348 | B2 * | 7/2013 | Strobel | A24C 5/1857 198/689.1 |
| 2008/0248233 | A1 | 10/2008 | Levine | |
| 2011/0025344 | A1 * | 2/2011 | Kumagai | G01R 31/2893 324/555 |
| 2012/0255838 | A1 | 10/2012 | Strobel | |

FOREIGN PATENT DOCUMENTS

| | | |
|---|---|---|
| DE | 102011006803 | 10/2013 |
| DE | 102012204970 | 10/2013 |
| DE | 102012211069 | 1/2014 |
| DE | 102012223074 | 6/2014 |
| WO | WO2008/112612 | 9/2008 |
| WO | WO2014/090783 | 6/2014 |
| WO | PCT/EP2015/079192 | 3/2016 |

* cited by examiner

SUCTION BELT

CROSS REFERENCE TO RELATED APPLICATION

This application is a 35 U.S.C. § 371 of and claims priority to PCT International Application No. PCT/EP 2015/079192, which was filed Dec. 10, 2015, and was published as WO 2016/091989, and claims priority to European Patent Application No. 14197395.8, filed Dec. 11, 2014, the teachings of which are incorporated herein by reference.

TECHNICAL FIELD

The invention relates to a suction belt for transporting tobacco and/or filter material in the production of cigarettes, having a flat belt material that is formed into a ring, and having a plurality of openings that are disposed so as to be distributed across the surface of the belt material.

BACKGROUND OF THE DISCLOSURE

A suction belt of the generic type is known from DE 199 09 031 A1. The suction belt comprises a woven fabric from warp threads and weft threads between which pores or openings, respectively, are located such that an air permeability of the woven fabric that enables the tobacco or the filter material, respectively, to be suctioned by means of a vacuum results. In order for the conveyance of the tobacco or of the filter material, respectively, to be improved, one side of the belt is embodied so as to be smooth, and the other side is embodied so as to be extremely rough, the latter in this case being achieved by a specific type of weave in which the weft threads are raised. Moreover, the rough side is intended to enable improved engagement with a drive wheel or similar, so as to be able to drive the suction belt in a reliable manner.

A further suction belt of the generic type of which the ends in a connection region are connected by means of laser welding so as to form a continuous suction belt is described in DE 10 2011 006 803 B4. The suction belt likewise comprises a woven fabric having warp threads and weft threads between which openings for suctioning the tobacco or the filter material, respectively, are located.

Similar suction belts which likewise comprise woven fabrics of warp threads and weft threads and openings that are located between the warp threads and the weft threads are also known from DE 10 2012 204 970 A1, DE 10 2012 211 069 B4 or DE 10 2012 223 074 A1.

In the case of most suction belts there is frequently an issue with the fact that comparatively many tobacco fibers to be transported are suctioned through the suction belt and thus do not arrive at the location to where they are supposed to be transported. This is a comparatively minor problem in the case of particulate matter since the latter is in most instances not desirable in cigarettes anyway. However, if these are comparatively large fibers, a comparatively high loss of up to 10% of the tobacco material invested can be incurred, which can lead to respective losses in financial terms. While it is indeed possible in principle for the tobacco fibers that have been suctioned through the suction belt to be used again, this likewise represents a complexity which leads to undesirable costs.

BRIEF DESCRIPTION OF THE DRAWINGS

Further advantageous design embodiments and refinements of the invention are derived from the remaining dependent claims. Exemplary embodiments of the invention are illustrated in principle hereunder by means of the drawing in which:

DETAILED DESCRIPTION OF THE EMBODIMENTS

Figure 1:
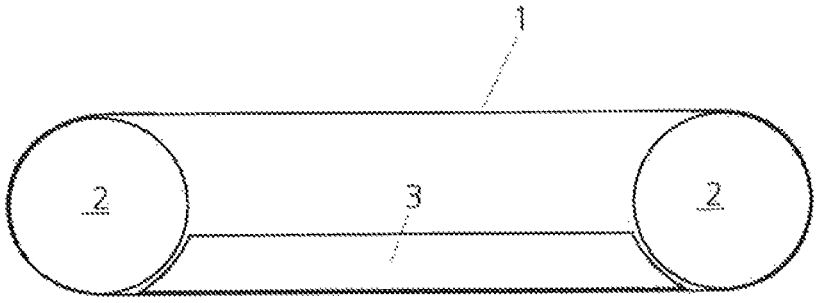
FIG. 1 shows a highly schematic illustration of a suction belt according to the invention in the employment thereof for transporting tobacco and/or filter material.

It is therefore the object of the present invention to achieve a suction belt for transporting tobacco and/or filter material in the production of cigarettes which by way of simple means enables a reduction or a limitation, respectively, of the amount of tobacco or filter material, respectively, that is suctioned through the suction belt.

This object is achieved according to the invention by the features described throughout this document.

By way of the available extent of 0.3 mm or less according to the invention, which at least 75% of all openings that are disposed so as to be distributed across the surface of the belt material have, it is prevented in the case of the vast majority of the tobacco fibers that are contained in the tobacco that said tobacco fibers are suctioned through the suction belt. This leads to a substantially lower loss of tobacco or filter material, respectively, than is the case with known suction belts such that significant cost savings can be made.

The openings of the suction belt according to the invention are thus embodied such that tobacco fibers beyond a specific size are reliably transported onward and thus ultimately make their way into the cigarette, whereas very short tobacco fibers and particulate matter are suctioned through the suction belt and cannot make their way into the cigarette, this significantly increasing the quality of the latter.

The solution according to the invention is implementable in many ways but always at very low costs, in particular in comparison to solutions in which complex devices or similar are employed for recycling the proportion of tobacco that is suctioned through the suction belt.

Depending on the desired degree of filtration, that is to say the maximum amount of lost tobacco and/or filter material, it can be provided in one very advantageous refinement of the invention that at least 75% of all openings have an available extent of 0.25 mm or less, preferably 0.22 mm or less, more preferably 0.2 mm or less, furthermore preferably 0.17 mm or less, most preferably 0.15 mm or less.

A further possibility of suctioning as few tobacco fibers as possible through the suction belt can be that at least 80%, preferably at least 85%, more preferably at least 90%, of all openings have an available extent of 0.3 mm or less.

An embodiment of the suction belt that can be produced with very little complexity and in a reliable process results when the belt material comprises a woven fabric having warp threads and weft threads, wherein the openings are located between the warp threads and the weft threads.

A simple possibility for setting the above-described size of the openings in the surface of the suction belt results when the two mutually opposite faces of the belt material in a further embodiment of the invention are embodied so as to be substantially mutually symmetrical, wherein the woven fabric is woven by way of a plain weave and/or a twill weave. Very high air permeability by virtue of the large number of weave points is provided in particular when a plain weave is used, on account of which suctioning of the tobacco or of the filter material, respectively, in a reliable process is achieved.

In the case of a woven fabric being used for forming the suction belt it can be advantageous for achieving the above-described size of the openings that the warp threads and/or the weft threads have a thickness of approx. 0.25 mm or less.

As an alternative to the use of a woven fabric for the belt material it can also be provided that the belt material comprises a knitted fabric, a warp-/weft-knitted fabric, a cross-laid yarn scrim, or a combination thereof. Cost advantages can optionally result on account thereof.

A further alternative to the use of a woven fabric for the belt material can be that the belt material comprises a flat plastic film in which the openings are located. Such a belt material can be produced in various ways, and the openings can be incorporated by perforation, for example.

In one further very advantageous embodiment of the invention it can be provided that the two lateral peripheries of the suction belt are embodied so as to be substantially straight. By way of such a straight embodiment of the two lateral peripheries of the suction belt it is prevented that tobacco fibers and/or filter material are suctioned past the side of the suction belt, which likewise leads to a reduction in the loss of tobacco fibers or filter material, respectively.

It is to be considered particularly advantageous herein when the two lateral peripheries of the belt material are embodied so as to be straight in such a manner that the former do not have any depressions having an available extent of more than 0.3 mm.

In one further advantageous design embodiment of the invention it can be provided that the suction belt has two ends which in a connection region are connected by laser welding to form a continuous suction belt. A very solid and durable connection of the suction belt results from the connection of the ends of the suction belt by means of laser welding. On account thereof, the suction belt can be mounted at higher tension forces, and the roughness which by virtue of the smooth embodiment of the two faces is no longer present and to date has been used for driving the suction belt can be compensated for.

A method for producing a suction belt is stated . The described straightening of the two lateral peripheries of the belt material can be carried out in a simple manner by way of such a method.

FIG. 1 shows a suction belt 1 which serves for transporting tobacco and/or filter material (both not illustrated in the figures) in the production of cigarettes in a highly schematic illustration. The suction belt 1 can be employed in a manner known per se in a machine for producing cigarettes, for example. In the present case, the suction belt 1 that is formed into a ring revolves about two rollers 2 of which at least one is driven. The rollers 2 can be embodied as gear wheels, for example, so as to achieve an improved connection to the suction belt 1 in order for the latter to be driven. Of course, other design embodiments of the rollers 2 are also possible. It can furthermore be provided that the suction belt 1 revolves about more than the two rollers 2. However, since such arrangements are known per se, in the sense of a simplification of the illustration said arrangements are not visualized.

The continuous suction belt 1 is configured so as to be contiguous to a vacuum chamber 3 which by way of the vacuum or negative pressure, respectively, prevailing therein serves for suctioning the tobacco or the filter material, respectively, toward the suction belt 1. Since this procedure is also known per se, it is likewise not described in more detail here.

Figure 2:
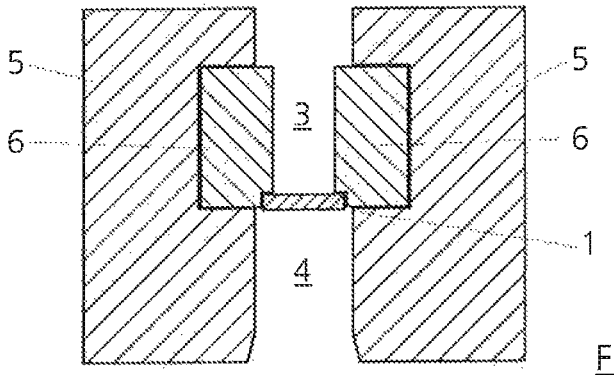
FIG. 2 shows a schematic illustration of a section through a suction duct in which the suction belt according to the invention in the employment thereof is disposed.

A suction duct 4 through which the suction belt 1 runs is illustrated in FIG. 2. The suction duct 4 on both sides is delimited by respective lateral stands 5 in which guide strips 6 on which the suction belt 1 ideally bears are inserted. The vacuum chamber 3, already illustrated in FIG. 1, is located above the suction belt 1. The illustration of FIG. 2 is to be considered highly schematic since the former is merely intended to indicate the purpose of employment of the suction belt 1 for transporting tobacco and/or filter material.

Figure 3:
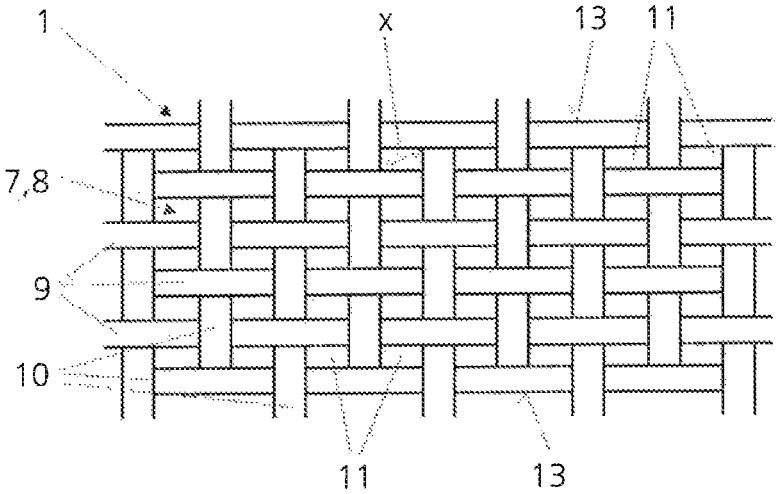
FIG. 3 shows a highly schematic plan view of a first embodiment of a suction belt according to the invention.

FIG. 3 shows a first embodiment of the suction belt 1. The suction belt 1 has a flat belt material 7 which in a manner not illustrated is formed into the ring illustrated in FIG. 1 and at the ends thereof in a connection region (not illustrated) is connected, for example by means of laser welding, so as to form the continuous belt material 7. Laser welding of the belt material 7 in order for the continuous suction belt 1 to be obtained is described in detail in DE 10 2012 223 074 A1, for example, and is therefore not explained in more detail herein. Of course, in order for the continuous suction belt 1 to be formed, the two ends of the belt material 7 can also be connected by means of ultrasonic welding or another suitable method. The belt material 7 used for the suction belt 1 can have a thickness of 0.5 to 2.5 mm, for example.

The belt material 7 in the case of the embodiment of FIG. 3 comprises a woven fabric 8 having warp threads 9 and weft threads 10. Openings 11 which can also be referred to as pores, holes, gaps, or clearances, are located between the warp threads 9 and the weft threads 10. The openings 11 in the woven fabric 8, or in principle in the belt material 7 which forms the suction belt 1, serve for allowing the vacuum or the negative pressure, respectively, prevailing in the vacuum chamber 3 to act through the suction belt 1 and thus for suctioning the tobacco or the filter material, respectively, toward the suction belt 1. To this end, a specific air permeability of the belt material 7 is required, the former resulting from the openings 11. On the other hand, it may arise that tobacco fibers in particular are suctioned through the openings 11 into the vacuum chamber 3. These tobacco fibers are then not transported to the desired location and are initially lost. In order for this to be prevented, it is provided in the case of the suction belt 1 that at least 75% of all openings 11 have an available extent, identified by "x" in FIG. 3, of 0.3 mm or less. The proportion of openings 11 which have an available extent of more than 0.3 mm can result by virtue of respective production tolerances, for example.

The term "available extent" is understood to be the maximum width or length, respectively, of the respective opening 11. In the case of the schematic illustration of FIG. 3, in which the openings 11 are illustrated so as to be substantially rectangular, said "available extent" herein is a diagonal within this rectangle. However, the available extent in the case of the woven fabric 8 does not only result within the face in which said woven fabric extends but also in the directions that deviate from this face and thus also in a spatial direction. In the case of a very tightly woven fabric 8, the openings 11 in principle can also be present only in that direction that extends away from the face in which the woven fabric 8 extends. The available extent of the openings 11 in another direction is likewise identified by "x" in FIG.

4. In most cases, the available extent that is identified by "x" is a spatial diagonal of the opening 11.

Since the available extent is a consequence of the intersection point of the warp threads 9 and the weft threads 10, the former can also be set by way of the diameter of the warp threads 9 and/or weft threads 10. Furthermore, the available extent of the openings 11 can be varied by way of the tension that is applied to the suction belt 1. The available extent of the openings 11 is thus reduced when the belt tension is increased.

In order for the filtration effect of the suction belt 1 to be adapted to the respective type of application it can also be provided that at least 75% of all openings 11 have an available extent of 0.25 mm or less, preferably 0.22 mm or less, more preferably 0.2 mm or less, furthermore preferably 0.17 mm or less, most preferably 0.15 mm or less. Furthermore, at least 80%, preferably at least 85%, more preferably at least 90%, of all openings 11 can have an available extent of 0.3 mm or less. These two restrictions or extensions, respectively, can be interlinked in an arbitrary manner. By combining these two restrictions it is thus possible for at least 90% of all openings 11 to have an available extent of 0.15 mm or less, for example.

The described available extent of the openings 11 in the case of the embodiment of FIG. 3 can be achieved by a respective type of weave of the woven fabric 8. For example, the woven fabric 8 as is illustrated in FIG. 3 can be woven by way of a plain weave. Furthermore, a twill weave or a combination of two types of weave is also conceivable for the woven fabric 8. In the case of a twill weave being used, a 2/1 twill weave, that is to say a weave having two warp threads 9 and one weft thread 10 is preferably employed. By way of the use of suitable warp threads 9 and weft threads 10 in combination with a suitable type of weave, the available extent of the openings 11 can be placed into the above-described desired range. The density of the warp threads 9 and/or of the weft threads 10 is thus set such that the desired available extent of the openings 11 is achieved. For example, the warp threads 9 and/or the weft threads 10 can have a thickness of approx. 0.25 mm or less. While threads having a thickness of approx. 0.25 mm are often used for the warp threads 9, the weft threads 10 can have a thickness of 0.18 to 0.22 mm, for example.

The woven fabric 8 furthermore is woven such that the two mutually opposite faces of the woven fabric 8 and thus of the belt material 7 that is formed therefrom are embodied so as to be substantially mutually symmetrical. In the present case, the two mutually opposite faces of the woven fabric 8, or of the belt material 7, respectively, are embodied so as to be as smooth as possible, this representing a departure from the suction belts as used to date, which in most instances have one comparatively smooth side and one side that is very much rougher.

The warp threads 9 and the weft threads 10 are preferably configured as monofilament threads and are from PEEK or from polyamide. Other materials can optionally also be employed.

Figure 4:
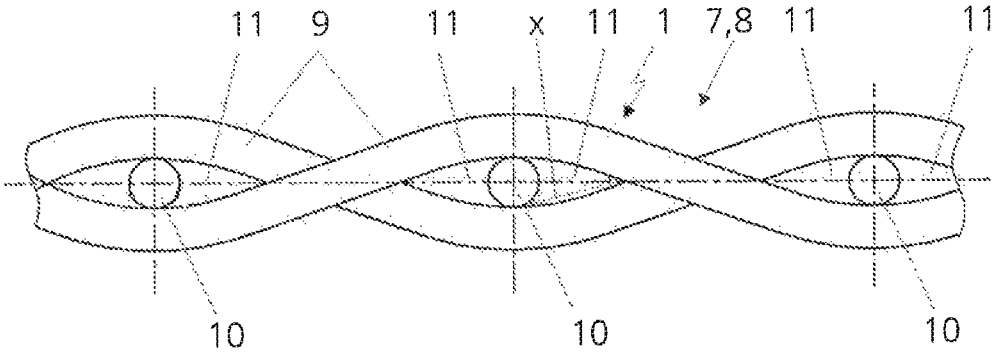
FIG. 4 shows a schematic side view of the suction belt of FIG. 3.
Figure 5:
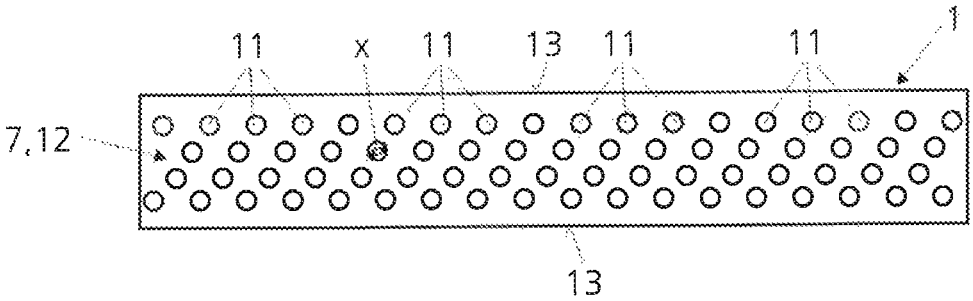
FIG. 5 shows a highly schematic plan view of a second embodiment of a suction belt according to the invention.

In the case of the embodiment of the suction belt 1 of FIG. 5, said suction belt 1 likewise comprises the belt material 7 which in this embodiment, however, is formed by a planar plastic film 12 in which the openings 11 are located. In terms of the maximum size of the openings 11 and of the minimum proportion by percentage of the openings 11 that have this size the same as has been mentioned in the context of FIGS. 3 and 4 applies. The available extent of the openings 11 is herein also identified by "x".

The plastic film 12 can be produced in a manner known per se which will thus not be described in more detail herein, wherein the openings 11 can be incorporated for example by perforation by means of needles, by means or laser radiation, or similar. Of course, it is also possible for the openings 11 to be incorporated already in the production process of the plastic film 12, for example in that the plastic film 12 is cast in a respective mold in which protrusions, pins, or similar which form the openings 11 in the plastic film 12 are located. In this case, it is also possible for the plastic film 12 that forms the belt material 7 to be produced by a generative production method, for example by means of selective laser sintering or 3D printing. In such a case, the openings 11 can already be omitted during the production of the plastic film 12 such that in the case of laser sintering, for example, the material that forms the plastic film 12 is not sintered at that location where the openings 11 are to be located.

In particular when the plastic film 12 is used for the belt material 7, round, oval, triangular, and/or polygonal shapes may also be employed apart from the respectively rectangular or quadrangular shapes of the openings 11. In the case of a round shape of the opening 11, the available extent of the latter is formed by the diameter, while in the case of a triangular shape of the opening 11 the longest leg of the triangle forms the available extent. The same applies in an analogous manner to the other shapes.

The suction belt 1 has a very large number of openings 11. It is prevented in this way that all of the openings 11 are clogged by the tobacco or the filter material, respectively, so that sufficient free openings 11 are available at all times, and particulate matter or very small tobacco fibers are suctioned through the suction belt 1 and do not make their way into the cigarette.

The two peripheries of the belt material 7 that are identified by the reference sign 13 are preferably embodied so as to be substantially straight. The term "substantially straight" is to be understood to mean that neither lateral periphery 13 of the belt material 7 has any depressions of a size of more than 0.3 mm. It is prevented by this straightening of the peripheries 13 that the tobacco can make its way past the suction belt 1 into the vacuum chamber 3. The size of the depressions (not illustrated in FIGS. 3 and 4) can be adapted to the size of the available extent of the openings 11 as described in more detail above in order to achieve a specific degree of filtration by the suction belt 1. The same that has been mentioned in the context of the openings 11 likewise applies to the maximum size of the depressions on the peripheries 13 of the belt material 7 as well as to the minimum proportion by percentage of the depressions that have this size.

Depending on the embodiment of the belt material 7 of the suction belt 1, this straightening of the lateral peripheries 13 can be performed in various ways. For example, it can be provided in the case where the woven fabric 8 is used for the belt material 7 that at least the two laterally outboard warp threads 9 of the woven fabric 8 are composed of a multifilament yarn. In this case, the weave of the respective weft thread 10 nestles to the structure such that a substantially straighter belt edge is created. Furthermore, in the case of a monofilament thread being used for the warp threads 9, the monofilament can be finely crimped such that the respective weft thread 10 at all times lies in the depression that is formed by said crimping and closes said depression.

Additionally or alternatively, it can be provided that additional material is applied in the peripheral region of the belt material 7, for example by means of fusing, welding, printing, coating, depositing, filling, and/or extruding.

Herein, when fusing, the material that is already available is employed, wherein additional material is employed in welding, printing, coating, depositing, filling, or extruding. The straight edge in the region of the peripheries 13 in this instance can be produced for example by means of cutting, abrading, or similar.

For example, one of the warp threads 9 can also have specific pigments such that the former by way of laser radiation can be fused so as to form a compact region in the region of the peripheries 13 such that the peripheries 13 are achieved so as to be straight and having depressions with a maximum available extent of 0.3 mm. The belt material 7 in the region of the peripheries 13 can also be compacted by heating in order for the roughness of the edges to be filled.

In principle, it would also be possible for the belt material 7 in the region of the peripheries 13 to be closed by way of a 3D printer or a similar device. In this case, cutting or abrading, respectively, could optionally be dispensed with.

In the case of a plastic film 12 being used for the belt material 7, said plastic film 12 can be produced such that the lateral peripheries 13 thereof are already substantially straight.

In principle, it would also be possible for the described straightening of the peripheries 13 of the suction belt 1 to also be employed in the case of such suction belts in which the openings 11 have an available extent of more than 0.3 mm. The feature of the two lateral peripheries 13 of the belt material 7 being embodied so as to be substantially straight is thus not necessarily linked to the feature of at least 75% of all openings 11 having an available extent of 0.3 mm or less.

As an alternative to the use of the woven fabric 8 or of the plastic film 12, respectively, for the belt material 7, the belt material 7 can also comprise a knitted fabric, a warp-/weft-knitted fabric, and/or a cross-laid yarn scrim, or combinations of these planar textile structures, respectively.

Furthermore, it would also be possible for the suction belt 1 to be employed as a trimming belt for shaping filters. In this case, the hot steam can penetrate the belt through the openings 11.

The invention claimed is:

1. A suction belt for transporting tobacco and/or filter material in the production of cigarettes, having a flat belt material that is formed into a ring, and having a plurality of openings that are disposed so as to be distributed across the surface of the belt material, characterized in that at least 75% of all openings have an available extent of 0.3 mm or less.

2. The suction belt as claimed in claim 1, characterized in that at least 75% of all openings have an available extent of 0.25 mm or less, preferably 0.22 mm or less, more preferably 0.2 mm or less, furthermore preferably 0.17 mm or less, most preferably 0.15 mm or less.

3. The suction belt as claimed in claim 1, characterized in that at least 80%, preferably at least 85%, more preferably at least 90%, of all openings have an available extent of 0.3 mm or less.

4. The suction belt as claimed in claim 1, characterized in that the belt material comprises a woven fabric having warp threads and weft threads wherein the openings are located between the warp threads and the weft threads.

5. The suction belt as claimed in claim 4, characterized in that the two mutually opposite faces of the belt material are embodied so as to be substantially mutually symmetrical, wherein the woven fabric is woven by way of a plain weave and/or a twill weave.

6. The suction belt as claimed in claim 4, characterized in that the warp threads and/or the weft threads have a thickness of approx. 0. 25 mm or less.

7. The suction belt as claimed in claim 1, characterized in that the belt material comprises a knitted fabric, a warp-/weft-knitted fabric, a cross-laid yarn scrim, or a combination thereof.

8. The suction belt as claimed in claim 1, characterized in that the belt material comprises a flat plastic film in which the openings are located.

9. The suction belt as claimed in claim 1, characterized in that the openings have a quadrangular, rectangular, round, oval, triangular, and/or polygonal shape.

10. The suction belt as claimed in claim 1, characterized in that two lateral peripheries of the belt material are embodied so as to be substantially straight.

11. The suction belt as claimed in claim 10, characterized in that the two lateral peripheries of the belt material are embodied so as to be straight in such a manner that the former do not have any depressions having an available extent of more than 0.3 mm.

12. The suction belt as claimed in claim 10, characterized in that straightening of the two lateral peripheries of the belt material is established by fusing, welding, printing, coating, depositing, filling, extruding, cutting, and/or abrading.

13. The suction belt as claimed in claim 12, characterized in that straightening of the two lateral peripheries of the belt material results on account of being at least the two outboard warp threads are composed of a multifilament yarn.

14. The suction belt as claimed in claim 1, characterized in that the belt material has two ends which in a connection region are connected by laser welding to form the continuous belt material.

15. A method for producing a suction belt as claimed in claim 10, characterized in that the two lateral peripheries of the belt material are straightened by means of by fusing, welding, printing, coating, depositing, filling, extruding, cutting, and/or abrading.

* * * * *